United States Patent [19]

Uchida

[11] 4,047,753

[45] Sept. 13, 1977

[54] FOLDABLE CHAIR WITH ROCKING MEANS

[75] Inventor: Suekichi Uchida, Aichi, Japan

[73] Assignee: Uchida Sharyo Co., Ltd., Nagoya, Japan

[21] Appl. No.: 629,564

[22] Filed: Nov. 6, 1975

[51] Int. Cl.[2] ..... A47C 3/02

[52] U.S. Cl. ..... 297/32; 297/131; 297/272

[58] Field of Search ..... 297/32, 33, 45, 131, 297/272

[56] References Cited

U.S. PATENT DOCUMENTS

| | | | |
|---|---|---|---|
| 264,917 | 9/1882 | Andrews | 297/272 X |
| 715,346 | 12/1902 | Brubaker | 297/33 |
| 947,681 | 1/1910 | Horton | 297/131 X |
| 1,250,045 | 12/1917 | Steinbach | 297/131 X |
| 1,767,736 | 6/1930 | Brown | 297/45 X |
| 2,403,558 | 7/1946 | Schoof | 297/45 |

FOREIGN PATENT DOCUMENTS

| | | | |
|---|---|---|---|
| 1,268,202 | 6/1961 | France | 297/272 |
| 464,107 | 11/1948 | Italy | 297/131 |

*Primary Examiner*—Roy D. Frazier
*Assistant Examiner*—Peter A. Aschenbrenner
*Attorney, Agent, or Firm*—Flynn & Frishauf

[57] ABSTRACT

A pair of rocker members are pivotally connected respectively to a pair of legs of a foldable chair. Each of the rocker members has an arcuate portion. When the chair is folded, each rocker member is housed in a space defined between the front and rear leg sections of a corresponding one of said legs. When the chair is used as a rocking chair, the rocker member is swung from said housed position and the arcuate portion of the rocker member is allowed to project downwardly from the bottom section of its corresponding leg to contact the floor. A supplemental rocker element is detachably fitted to the rear end portion of each rocker member.

8 Claims, 4 Drawing Figures

FOLDABLE CHAIR WITH ROCKING MEANS

BACKGROUND OF THE INVENTION

This invention relates to a simple foldable chair whose pair of frameworks are made respectively of tubular steels, and more particularly to a novel improvement enabling the chair to be used as a "rocking chair" as well.

The present inventor has proposed, in his previous U.S. patent application Ser. No. 482,522 entitled "Folding Chair" and filed June 24, 1974, a foldable chair wherein a pair of U-shaped legs intersect each other into an X-like configuration and at those two intersections both legs are connected to each other by proper connecting means, for example, by pivot pins, whereby a pair of frameworks can be inwardly folded about the center line of the chair including said two intersections.

Further, another foldable chair of the same type as mentioned above is disclosed in the specification of U.S. Pat. No. 3,891,914 entitled "Collapsible Chair".

The above-mentioned conventional foldable chairs are ordinary, practical "unrocking chairs" of the type wherein the bottom sections of the pair of U-shaped legs are formed linear and these linear bottom sections are contacted with the floor to give a seated person a feeling of stableness.

Further, a foldable chair is also known which is constructed as a so-called "rocking chair" in such a manner that the bottom sections of the U-shaped legs are formed arcuate and the chair is rocked back and forth through the rolling of said arcuate sections on the floor.

However, among the above-mentioned foldable chairs the one constructed as a "rocking chair" functions only as a "rocking chair", while the one constructed as a practical, "unrocking chair" has only the function as a practical, stable chair. That is, there has not yet been reported a foldable chair which has both the rocking and unrocking functions, and is simple in construction, easy to manufacture and low in manufacturing cost.

SUMMARY OF THE INVENTION

The object of the invention is to provide a foldable chair which can be used as a practical, unrocking chair or as a rocking chair through selection by a user and which is simple in construction, low in manufacturing cost, and easy to handle.

In the foldable chair of the invention, a pair of rocker members are pivotally supported, at the end portions thereof, by the front and rear leg sections of the leg respectively. The rocker member is formed with an arcuate portion so functioning as to permit the chair to be rocked. When the chair is used as a practical, unrocking chair, the arcuate portion of the rocker member is housed in a space between the front and rear leg sections of the leg. In contrast, when the chair us used as a "rocking chair", the rocker member is swung from said housed position in which the rocker member engages the inside of the leg with said arcuate portion projecting downwardly from the bottom section of the leg. Further, when the chair is used as a "rocking chair", a supplemental rocker element so rearwardly extending as to elongate the arcuate portion along the arcuately curved line of the arcuate portion is detachably fitted to the rear side of each rocker.

The foldable chair having the foregoing construction can be used both as a practical unrocking chair and as a rocking chair by selectively swinging the rocker member, which offers the advantages that the foldable chair of the invention has wide-availability; the rocker member operation is extremely easy; and both the rocker member and the supplemental rocker element can be made of similar tubular steel pipes, and which offers a further advantage of providing a simple and inexpensive foldable chair.

DETAILED DESCRIPTION OF THE PREFERRED EMBODIMENTS

Figure 1:
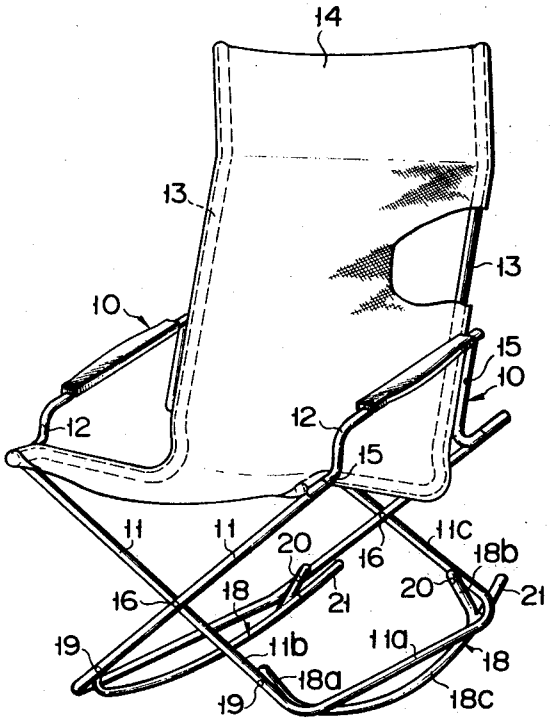
FIG. 1 is a perspective view of an unfolded state of a foldable chair with rocking means according to the invention.

Referring to FIG. 1, a foldable chair is provided with a pair of frameworks 10, 10 each made of tubular steel pipe. Each of the frameworks 10, 10 is comprised of an angular U-shaped leg 11, an arm rest bar 12, and an L-shaped seat supporting bar 13. Between the respective seat supporting bars 13 of the pair of frameworks 10, 10 is stretched a thin flexible seat member 14 made of suitable plastic or woven fabric and formed integrally with a back rest portion.

The seat supporting bars 13 are fixed by bolts 15 to their arm rest bars 12 at two points, respectively. Each of the U-shaped legs 11 has a linear bottom leg section **11*a*, a front leg section 11*b*, and a rear leg section 11*c* parallel with the section 11*b*. The respective upper ends of the front leg section 11*b* and rear leg section 11*c* are pivotally coupled to the front and rear ends of the arm rest bar 12. The front leg portions 11*a*, and the rear leg portions 11*c*, of both legs 11 are pivotally connected, respectively, to each other by pivot pins 16 constituting connecting means, in a manner that said front leg portions 11*b*, and said rear leg portions 11*c*, intersect, respectively, each other into an X-like configuration near the middle of the length of the portions 11*b*, 11*c*. Accordingly, the pair of frameworks 10 are made inwardly foldable about a line passing through the front and rear pivot pins 16** and constituting a center of the foldable chair.

The above-described constituent parts of the foldable chair of the invention are substantially the same as those of a foldable chair described in said U.S. patent application Ser. No. 482,522, and description thereof is made no further in detail than the foregoing.

Hereinafter, explanation is made of a specific rocking means according to the invention provided for the leg 11 of each framework 10 and intended to rock the chair forwardly or backwardly.

Each rocking means has a rocker member 18, and each rocker member is comprised of a front portion **18*a*, a rear portion 18*b*, and an arcuate portion 18*c* between said front and rear portions 18*a*, 18*b*. Said rear portion 18*b* is parallel with the front leg secton 11*b* of said U-shaped leg 11** and is pivotally connected by a pivot pin 19 to the leg section 11*b* in the proximity of the upper end of said front portion 18*a*. Said rear portion 18*b* is substantially parallel with the rear leg section 11*c* of the leg 11 and is pivotally connected by a pivot pin 20 to the leg section 11*c* in the proximity of the upper end of said rear portion 18*b*. The front portion 18*a* and the arcuate portion 18*c* are formed by bending a single tubular steel pipe. The rear portion 18*b* is made of another tubular steel pipe and is integrally welded to the arcuate portion 18*c* near the rear end thereof, as shown in FIG. 3.

Figure 3:
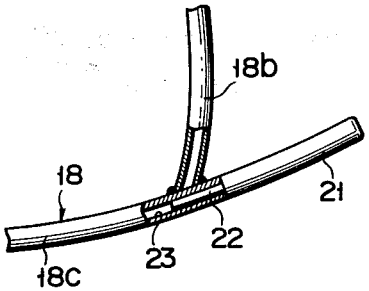
FIG. 3 is an enlarged view of main parts as viewed from side, for showing the engagement relationship between the rocker member and supplemental rocker element provided for the foldable chair of FIG. 1.

As shown in FIG. 3, a supplemental rocker element 21 is detachably fitted on the rear end of the arcuate portion 18*c*, in other words, of the rocker member 18. The element 21 consists of a small length of steel pipe, and has at its tip end a projection 22 integral therewith extending in the axial direction of the element 21. This projection 22 is axially inserted, with a prescribed frictional force, into a bore 23 axially formed in the rear end of the arcuate portion 18*c*. Under the condition wherein the rocker element 21 is attached to the rocker member as shown in FIG. 3, the element 21 is in axial alignment with the arcuate portion 18*c*. That is to say, by providing this element 21, the arcuate portion 18*c* assumes a configuration wherein it is extended rearwardly.

Figure 4:
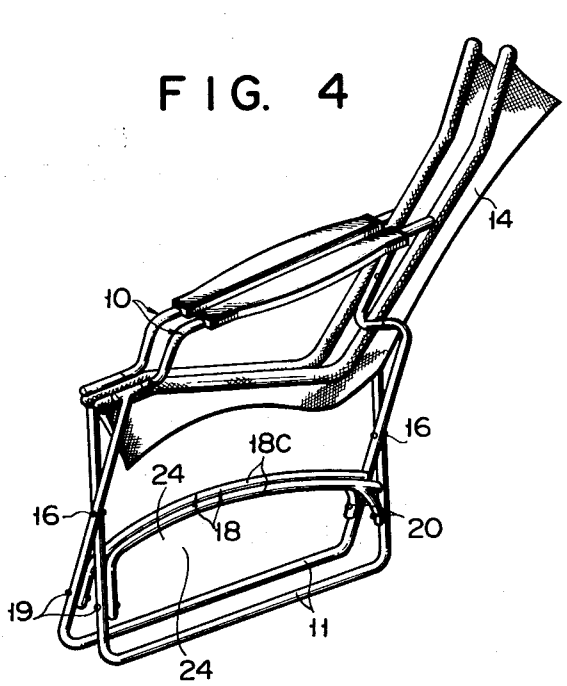
FIG. 4 is a perspective view of a folded state of the foldable chair shown in FIG. 1.

When the chair is out of use, the supplemental rocker element 21 is disengaged from the rocker member 18 as shown in FIG. 4, and each rocker member 18 is housed in a space 24 defined between the front leg secton 11*b* and the rear leg section 11*c* of the leg 11, in a state wherein the arcuate portion 18*c* of each rocker member 18 is turned up. As a result, the rocker member 18 lies flush with a plane including the corresponding leg 11. Accordingly, the chair can be sufficiently folded without any hindrance caused by the rocker member 18, as shown in FIG. 4. If the foldable chair is unfolded in a state wherein each rocker member 18 is housed as mentioned above, the linear bottom sections 11*a* of the legs 11 will be contacted with the floor. As a result, this foldable chair can be used as an ordinary unrocking chair which is free from the rocking motion.

When the foldable chair is desired to be used as a "rocking chair", it is unfolded, and the rocker members 18 are swung respectively about the pivot pins 19, 20 inwardly from their housed positions so as to permit the arcuate portions 18*c* to be turned downward. Thereafter, the supplemental rocker elements 21 are attached respectively to the rocker members 18.

Figure 2:
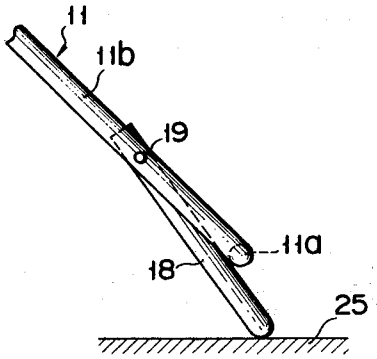
FIG. 2 is an enlarged view of main parts as viewed from front, for showing the engagement relationship between the rocker member and leg provided for the foldable chair of FIG. 1.

As shown in FIG. 2, each rocker member 18 is stopped at its fully swung position in such a manner that its arcuate portion 18*c* is engaged with the inside of its corresponding leg 11, particularly of its corresponding bottom section 11*a*. At said fully swung position, the arcuate portion 18*c* of each rocker member 18 is projected downwardly from its corresponding bottom section 11*c* of the leg 11, and a given small region of said arcuate portion is allowed to contact the floor 25. When the foldable chair is rocked back and forth, said given small region on the arcuate portion 18*c* contacting the floor 25 is successively changed.

While the foldable chair is being rocked back and forth, a force reacting on each rocker member 18 by the floor 25 against a force with which a seated person presses the seat member 14 is wholly received by the pivot pins 19, 20 and the inside portion of the leg 11 engaging the arcuate portion 18*c*. As a result, the rocker member 18 is rocked jointly with the corresponding leg 11 as if made integral with the leg 11. Further, provision of the supplemental rocker elements 21 results in an enlargement of the range in which the chair is to be rocked, and the supplemental rocker elements 21 so function as to support the chair so that when the chair is rocked, it may not fall backwardly. Accordingly, when the foldable chair of the invention is used as a "rocking chair", it gives a stableness and safety to any seated person. Further, during the use of the foldable chair, the projection 22 frictionally engages the bore 23 with a relatively large force, so that there is no fear of the rocker element 21 being unexpectedly disengaged from its corresponding rocker member 18.

Note that the foldable chair of the invention is sufficiently practically usable as a "rocking chair" if only, even though having no supplemental rocker element 21, it has the pair of rocker members 18 alone.

What is claimed is:

1. In a foldable chair of the type including a pair of frameworks, each comprised of pipes and provided with an angular U-shaped leg having front and rear leg sections and a bottom leg section therebetween, pivot pins connecting said U-shaped legs together to permit relative pivotal movement therebetween about said pivot pins for permitting said U-shaped legs to be put into an X-like configuration and to also permit the frameworks to be folded, a flexible seat member stretched on said frameworks, and two rocking means attached to said U-shaped legs, respectively, for rocking the chair, the improvements wherein:

each of said rocking means includes a pipe type rocker member which comprises front and rear portions pivotally connected by pivot pins to the front and rear leg sections of the corresponding U-shaped leg, respectively, and an arcuate portion between said front and rear portions, said rocker members being swingable inwardly of the chair relative to said U-shaped legs between upward and downward positions, said rocking means including means engageable with at least inside portions of the bottom leg sections of the U-shaped legs when they are in said downward position so as to be stopped and retained in said downward position;

said rocker members being pivotally swingable from an upward housed position where said arcuate portion is remote from said bottom leg sections and said chair rests on said bottom leg sections in a non-rocking condition, to a fully swung downward position where said rocker members are engaged with at least inside portions of the bottom leg sections of the U-shaped legs and are stopped and retained in said fully swung downward position with the arcuate portions of said rocker members protruding downwardly from the bottom leg sections, respectively, so that said chair rests on said arcuate portions and is in a rocking condition.

2. A foldable chair according to claim 1, wherein each rocking means further includes a supplemental pipe-like rocker element which is detachably connectable to the corresponding rocker member at the rear end thereof so as to extend in the axial direction of the arcuate portion of the corresponding rocker member.

3. A foldable chair according to claim 2 wherein each rocker member is dimensioned so as to lie, in its housed position, substantially flush with a plane including the corresponding leg when the corresponding supplemental rocker element is detached from the rocker member, whereby the chair can be folded without interference by said rocker members.

4. A foldable chair according to claim 2, wherein each supplemental rocker element has a projection extending from one end thereof in its axial direction, and the rear ends of said rocker members have respective bores in the arcuate portions thereof, each of said projections being detachably fitted in said bore of the corresponding rocker member and extending in the axial direction of said arcuate portion.

5. A foldable chair according to claim 4 wherein said projections are frictionally retained in said bores.

6. A foldable chair according to claim 1 wherein said pivot pins connecting said rocker member to said front and rear leg sections are spaced upwardly from said bottom leg sections.

7. A foldable chair according to claim 1 wherein said U-shaped legs and said rocker members are made of steel pipe.

8. A foldable chair according to claim 2 wherein said supplemental rocker element is made of steel pipe.

* * * * *